US005721304A

United States Patent [19]

Pasqua, Jr.

[11] Patent Number: 5,721,304

[45] Date of Patent: Feb. 24, 1998

[54] GOLF BALL COMPOSITION

[75] Inventor: Samuel A. Pasqua, Jr., Bristol, R.I.

[73] Assignee: Acushnet Company, Fairhaven, Mass.

[21] Appl. No.: 606,373

[22] Filed: Feb. 23, 1996

[51] Int. Cl.[6] ..... A63B 37/06

[52] U.S. Cl. ..... 524/433; 525/274; 473/371; 473/372; 473/377

[58] Field of Search ..... 473/371, 372, 473/377; 524/433; 525/274

[56] References Cited

U.S. PATENT DOCUMENTS 5,387,637 2/1995 Sullivan ..... 524/493

*Primary Examiner*—David Buttner

*Attorney, Agent, or Firm*—Pennie & Edmonds LLP

[57] ABSTRACT

A golf ball, a golf ball core and a method for making a golf ball and a golf ball core, using an admixture of polybutadiene, a zinc diacrylate cross-linker, and a calcium oxide that is substantially free of zinc oxide. When zinc oxide, typically used in golf ball cores, is eliminated or at least substantially reduced from a golf ball core composition, and calcium oxide is added, the golf balls and golf ball cores formed from such an admixture exhibit reduced PGA compression when compared to cores and balls containing zinc oxide, while maintaining the initial velocity of the standard higher compression cores and balls.

26 Claims, No Drawings

GOLF BALL COMPOSITION

FIELD OF THE INVENTION

This invention generally relates to golf balls, and, in particular, is directed to a composition used for the manufacture of golf ball cores, as well as a method for the manufacture of golf ball cores using the subject composition.

BACKGROUND OF THE INVENTION

Golf balls have greatly evolved since the introduction of the first such ball, a leather sack stuffed with goose feathers. Golf ball design and technology have now advanced to the point that the United States Golf Association (USGA), the organization that sets the rules of golf in the United States, has instituted a rule that prohibits the competitive use in any USGA sanctioned event of a golf ball that can achieve an initial velocity of 76.2 meters per second (m/s), or 250 ft/s, when struck by a driver with a velocity of 39.6 m/s, i.e., 130 ft/s (referred to hereinafter as "the USGA test"). However, an allowed tolerance of two percent permits manufacturers to produce golf balls that achieve an initial velocity of 77.7 m/s (255 ft/s).

The technology does exist to produce "hot" golf balls that exceed 77.7 m/s (255 ft/s) by a wide margin in the USGA test, and such hot balls are available. However, these hot balls are not legal for USGA sanctioned tournaments, or for establishing a USGA handicap. Therefore, manufacturers place a great deal of emphasis on producing golf balls that consistently achieve the highest possible velocity in the USGA test without exceeding the 77.7 m/s (255 ft/s) limit, which are available with a range of different properties and characteristics, such as spin, compression, "click," and "feel." Thus, a variety of different balls is available to meet the needs and desires of a wide range of golfers.

Today, golf balls are generally available as one-piece (i.e., unitary), two-piece, and three-piece (i.e., wound or solid multi-component) balls. One-piece balls lack a cover, and are typically formed with a dimpled surface from a molded polybutadiene based compound. Since these balls typically spin at a high rate, and have a low velocity, they do not provide the desired distance, and are generally used as practice or driving range balls.

In contrast, two-piece golf balls, used by the typical amateur golfer, provide maximum durability and distance. These balls have a core formed of a single solid sphere, which is typically formed of a polybutadiene based compound, and a cover of SURLYN® or other similar ionomer that encloses the core.

Three-piece balls, which are preferred by professionals and low handicap amateur golfers for their spin characteristics and feel, include either a solid rubber or a liquid center that is covered by many meters of elastic windings. Such cores are thereafter encased in a cover formed of SURLYN®, polyurethane, or balata rubber. The winding provides three-piece balls with a higher spin rate and more control for better golfers.

Regardless of the form of the ball, players generally seek a golf ball that delivers maximum distance, which requires a high initial velocity upon impact. Therefore, in an effort to meet the demands of the marketplace, manufacturers strive to produce golf balls with initial velocities in the USGA test that approximate the USGA maximum of 77.7 m/s or 255 ft/s as closely as possible.

To meet the needs of golfers having varying levels of skill, golf ball manufacturers are also concerned with varying the level of the PGA compression of the ball, which is a measurement of the deformation of a golf ball or core in inches under a fixed load. Higher velocity on impact, and, hence, greater distance, can often be achieved by increasing compression, which influences the distance the ball travels or rolls, and may also generate a harder "feel" to the ball. However, because a golf ball must be fully compressed on impact to achieve maximum velocity and distance, amateur golfers, who may not be able to generate the required club head speed, cannot obtain the maximum distance from a high compression ball.

Therefore, golf ball manufacturers are continually searching for new ways in which to provide golf balls that deliver the maximum performance for golfers of all skill levels, and seek to discover compositions that provide the performance of a high compression ball in balls with the lower compression required by amateur golfers.

A number of polymers, such as polybutadiene, natural rubber, styrene butadiene, and isoprene, are commonly used in fabricating golf ball cores. Today, golf ball cores are predominantly made of polybutadiene. Moreover, in order to obtain the desired physical properties for golf balls, manufacturers have added cross-linking agents, such as metallic salts of an unsaturated carboxylic acid. The amount of cross-linking agent added is typically about 20 to 50 parts per hundred parts of polybutadiene. Most commonly, zinc diacrylate or zinc dimethacrylate are used for this purpose. Of these two cross-linkers, zinc diacrylate has been found to produce golf balls with greater initial velocity than zinc dimethacrylate.

Typically, about 5 to 50 pph (parts per hundred) of zinc oxide (ZnO) is also added to the composition. This material serves as both a filler and an activation agent for the zinc diacrylate/peroxide cure system. The zinc diacrylate/peroxide cure system, which is well known to those of ordinary skill in this art, cross-links the polybutadiene during the core molding process. The high specific gravity of zinc oxide (5.57) can serve the dual purposes of adjusting the weight of the golf ball, in addition to acting as an activation agent.

As zinc oxide is known to be an environmentally unfriendly material, it would be advantageous to eliminate or at least substantially reduce the amount of this material from the manufacturing process. However, when the zinc oxide is eliminated from the composition described above, there is a reduction in cure enhancement, which results in less cross-linking and a corresponding reduction in compression and velocity. This result provides a ball with a softer feel, and allows less skilled golfers to compress the ball fully, but the resulting ball has less than the maximum velocity allowed by the USGA standard.

Therefore, it would be advantageous to provide a golf ball core composition with an activation agent other than zinc oxide, i.e., wherein all or at least some of the zinc oxide commonly present was eliminated, which would, as noted above, provide a ball with a lower compression, but would maintain the velocity and distance of a high compression ball. The present invention provides such a golf ball core.

SUMMARY OF THE INVENTION

The present invention is directed, in a first embodiment, to a composition for the manufacture of golf balls, and, in particular, golf ball cores. The composition comprises a base mixture of polybutadiene, a metal salt diacrylate or dimethacrylate, preferably, zinc diacrylate in an amount of about 20 to 50 parts per hundred parts of polybutadiene, and a free radical initiator, to which calcium oxide (CaO) is added instead of zinc oxide as an activation agent in an amount sufficient to produce a golf ball core with the advantageous properties discussed below.

It has been found that when zinc oxide is eliminated from a golf ball core composition as an activating agent in favor of calcium oxide, a lower compression golf ball core is obtained, which, when incorporated into a finished golf ball, provides a ball with an initial velocity in the USGA test that is comparable in velocity and distance to a standard, high compression ball that incorporates a core using zinc oxide. The calcium oxide is added in an amount that reduces the compression of the golf ball, while maintaining the initial velocity of the ball in the USGA test. Typically, the amount of calcium oxide incorporated into the core composition of the invention is between about 0.1 and 15 parts per 100 parts of polybutadiene. The amount of calcium oxide used is preferably less than about 15 pph because when more than 15 pph is used there appears to be a large decrease in the golf ball core compression that results in a significant reduction in the initial velocity of balls incorporating such cores. Therefore, to obtain a core and ball of the required weight, it may be necessary to include at least one filler material.

The present invention is further directed to a method of making a golf ball core composition that provides a lower compression golf ball with an initial velocity comparable to a higher compression ball, as well as to a product of such a method. The method of the invention comprises forming a mixture, which is substantially free of zinc oxide, comprising polybutadiene, a metal salt diacrylate, dimethacrylate, or monomethacrylate, preferably zinc diacrylate, and an amount of calcium oxide sufficient to produce a golf ball core having reduced compression, while maintaining the initial velocity of golf ball cores incorporating zinc oxide. The calcium oxide is preferably added to a mixture of polybutadiene and zinc diacrylate after the first two components are thoroughly blended. Alternately however, the calcium oxide may also be placed in a mixer with polybutadiene and a metal salt diacrylate, dimethacrylate, or monomethacrylate, so that the three components are blended simultaneously.

Typically, as the polybutadiene, metal diacrylate, and calcium oxide are mixed, the temperature of the mixture is from about 82.2° to about 93.3° C. (180°–200° F.). At least one free radical initiator is then added to the mixture. Preferred initiators are peroxide initiators, which are well known in the art of golf ball manufacturing. The temperature at which the free radical initiator should be added is readily apparent to one of ordinary skill in the art without the need for any experimentation. In the case of peroxides, for example, the addition temperature depends upon the peroxide chosen. Peroxides may be added with the initial charge at a temperature as low as 80° F., or alternately at a temperature just short of the vulcanization temperature for the resultant admixture. The admixture containing the initiator is then blended to form a homogeneous mixture, which is discharged and formed into golf ball cores.

The invention thus provides a novel golf ball composition that offers the environmental benefit of eliminating or at least reducing the use of zinc oxide, while providing a golf ball with enhanced performance properties.

DETAILED DESCRIPTION OF THE PREFERRED EMBODIMENTS

As used herein, the terms "core" and "golf ball core" are generic, and include one-piece or unitary golf balls, cores for two-piece golf balls, dual cores for two-piece golf balls, and centers for wound golf balls and the like. The core composition of the present invention can be used to form a unitary golf ball, a core for a two-piece golf ball, or a core for a three-piece or wound golf ball, as desired. However, the best results are obtained when the composition of the invention is used to form a core for a two-piece ball with a standard cover formed from a material such as a SURLYN® ionomer resin.

For purposes of the present invention, the term "reaction conditions" can refer to any reaction condition that can affect the ability of the inventive core compositions to form free radicals. Reaction conditions include, for example, temperature, time and pressure.

As used herein, the terms "points" or "compression points" refer to the PGA compression scale. This scale, which is well known to those working in this field, ranges from 1 to 160 points and is used in determining the relative compression of a core or ball. Some skilled artisans who do not use the PGA compression scale instead use Reihle compression values. Reihle compression values may be converted to PGA compression values through the use of the following equation:

$$\text{PGA compression value} = 160 - \text{Reihle compression value}.$$

A representative base composition for forming golf ball cores, prepared in accordance with the present invention, comprises polybutadiene and, in parts by weight based on 100 parts polybutadiene, 20–50 parts of a metal salt diacrylate, dimethacrylate, or monomethacrylate, preferably zinc diacrylate. The polybutadiene preferably has a cis 1,4 content of above about 90% and more preferably above about 96%. Commercial sources of polybutadiene include Shell 1220 manufactured by Shell Chemical, Neocis BR40 manufactured by Enichem Elastomers, and Ubepol BR150 manufactured by Ube Industries, Ltd. If desired, the polybutadiene can also be mixed with other elastomers known in the art, such as natural rubber, styrene butadiene, and/or isoprene in order to further modify the properties of the core. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity in the USGA test. The zinc diacrylate can be of various grades of purity. For the purposes of this invention, the lower the quantity of zinc stearate present in the zinc diacrylate the higher the zinc diacrylate purity. Zinc diacrylate containing about 1–10% zinc stearate is preferable. More preferable is zinc diacrylate containing about 4–8% zinc stearate. Suitable, commercially available zinc diacrylates include those from Rockland React-Rite and Sartomer. The preferred concentrations of zinc diacrylate that can be used are 20–50 pph based upon 100 pph of polybutadiene or alternately, polybutadiene with a mixture of other elastomers that equal 100 pph.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a-a his (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 and 2.5 pph based upon 100 parts of butadiene, or butadiene mixed with one or more other elastomers. More preferably, the amount of initiator added ranges between about 0.15 and 2 pph and most preferably between about 0.25 and 1.5 pph.

A typical prior art golf ball core incorporates 5 to 50 pph of zinc oxide in a zinc diacrylate-peroxide cure system that cross-links polybutadiene during the core molding process. The high specific gravity of zinc oxide, about 5.57, permits the adjustment of the specific gravity of the core and resulting golf ball incorporating the core. As noted above the elimination, or at least the reduction of environmentally unfriendly zinc oxide from the manufacturing process is desirable. However, in the case of golf ball core formulations, completely eliminating zinc oxide results in a significant reduction in cure enhancement, so that there is a reduction in the cross-linking of the polybutadiene with a resultant decrease in both compression and initial velocity in the USGA test. Although the core and resulting ball has a softer feel, and can be more easily compressed by amateur golfers, driving distance suffers as a result of the lower initial velocity.

It has now been discovered that when zinc oxide (ZnO) is eliminated in favor of calcium oxide (CaO) from a golf ball core composition of polybutadiene and a metal salt diacrylate, dimethacrylate, or monomethacrylate, the cores and balls produced from such an admixture typically exhibit enhanced performance properties. The initial velocity of the standard ball is maintained at or near the maximum allowed by the USGA, but the compression of the ball is reduced by at least about 2 compression points on the PGA scale, and may be reduced as much as 14 points. Where the amount of zinc oxide incorporated in prior art cores is, as noted above, typically about 5 to 50 pph, the amount of calcium oxide added to the core-forming composition of the invention as an activator is typically in the range of about 0.1 to 15, preferably 1 to 10, most preferably 1.25 to 5, parts calcium oxide per hundred parts (pph) of polybutadiene.

The compositions of the present invention may also include fillers, added to the elastomeric composition to adjust the density and/or specific gravity of the core. As used herein, the term "fillers" includes any compound or composition that can be used to vary the density and other properties of the subject golf ball core. Fillers useful in the golf ball core according to the present invention include, for example, zinc oxide (in an amount significantly less than that which would be necessary without the addition of the calcium oxide), barium sulfate, and regrind (which is recycled core molding matrix ground to 30 mesh particle size). The amount and type of filler utilized is governed by the amount and weight of other ingredients in the composition, since a maximum golf ball weight of 1.620 ounces (45.92 gm) has been established by the USGA. Appropriate fillers generally used range in specific gravity from about 2.0 to 5.6.

Golf ball cores made according to the present invention can be of any specific gravity which can be used in a golf ball. The preferred range of specific gravities of the present invention is from about 0.9 to about 1.5 or more, more preferably in the range of about 1 to about 1.25, depending upon the size of the core, cover, and finished ball, as well as the specific gravity of the cover.

Antioxidants may also be included in the elastomer cores produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Other ingredients such as accelerators, e.g. tetra methylthiuram, processing aids, processing oils, plasticizers, dyes and pigments, as well as other additives well known to the skilled artisan may also be used in the present invention in amounts sufficient to achieve the purpose for which they are typically used.

The compositions of the invention are typically produced by forming a mixture comprising at least polybutadiene, zinc diacrylate, and an amount of calcium oxide sufficient to reduce the compression by at least about 2 points on the PGA compression scale, compared to a core composition substituting zinc oxide for the calcium oxide, optionally with one or more additional components, such as additives. When a set of predetermined conditions is met, i.e., time and temperature of mixing, the free radical initiator is added in an amount dependent upon the amounts and relative ratios of the starting components, as would be well understood by one of ordinary skill in the art. In particular, as the components are mixed, the resultant shear causes the temperature of the mixture to rise. Peroxide(s) free radical initiator(s) are blended into the mixture for crosslinking purposes in the molding process.

After completion of the mixing, the golf ball core composition is milled and hand prepped or extruded into pieces ("preps") suitable for molding. The milled preps are then compression molded into cores at an elevated temperature. Typically, 160° C. (320° F.) for 15 minutes is suitable for this purpose. These cores can then be used to make finished golf balls by surrounding the cores with standard cover materials.

EXAMPLES

These and other aspects of the present invention may be more fully understood with reference to the following non-limiting examples, which are merely illustrative of the preferred embodiments of the present invention, and are not to be construed as limiting the invention, the scope of which is defined by the appended claims.

EXAMPLES 1–3

The results obtained with golf ball cores and balls prepared according to the following examples are representative of the improved performance characteristics of is golf ball cores and golf balls made from the compositions of this invention. The compositions used to prepare the golf balls of these examples contained the ingredients listed in TABLE I below in the specified amounts, which are all in parts per hundred (pph), based on 100 parts of polybutadiene. The fillers used in the compositions of these examples are regrind and barium sulfate ($BaSO_4$). Either calcium oxide or zinc oxide is used as an activation agent. Vulcup 40KE® and Varox 231XL® are free radical initiators, and are a-a bis (T-butylperoxy) diisopropylbenzene and 1,1-di (T-butylperoxy) 3,3,5-trimethyl cyclohexane, respectively. Yel MB is a yellow pigment in a styrene butadiene binder, which is used to color the composition for identification purposes. The zinc diacrylate contained no more than about 4–8% zinc stearate.

All the ingredients except the peroxides were mixed in a Process Lab Brabender mixer to 82.2°–93.3° C. (180°–200° F.). The peroxides were added in the second stage to the initial mixture, and the resulting mixture was removed from the Brabender and blended on a lab mill to insure homogeneity. After mixing, the admixture was then hand rolled using a laboratory mill and cut into pieces or "preps". These preps were then compression molded at 160° C. (320° F.) for 15 minutes to form the cores. To fabricate the finished golf balls, the cores were inserted into two cover hemispheres of a lithium-sodium blend of SURLYN®, which were molded to encase the core.

The cores and balls prepared according to the above-described method were tested for their PGA compression and initial velocity. The compression ratings were obtained using a commercial PGA compression tester. The initial velocity results were obtained from a standard technique, whereby the cores or balls are struck at 39.6 m/s (130 ft/s), and pass through light gates, which measure their speed. Both of these standard measurement techniques are well-known to those of ordinary skill in the art of making golf ball cores and balls. As shown below in TABLE II, a 50 percent reduction in the zinc oxide concentration in Example 1 results in a decrease in ball compression of only 1.6 points and a slight drop in initial velocity. Similar results are obtained with the core. The complete removal of zinc oxide in Example 2 reduces the compression of both the core and the ball by 12 points, but also reduces the initial velocity of the core and ball significantly. When the zinc oxide is eliminated from the core composition, and calcium oxide is added in Example 3, both the cores and finished balls containing calcium oxide have a lower compression, but the initial velocity of the low compression balls and cores is comparable to that of the high compression control.

TABLE I

| | Control | 1 | 2 | 3 |
|---|---|---|---|---|
| Polybutadiene | 100.0 | 100.0 | 100.0 | 100.0 |
| Regrind | 16.3 | 16.3 | 16.3 | 16.3 |
| Vulcup 40KE ® | 0.23 | 0.23 | 0.23 | 0.23 |
| Varox 231XL ® | 0.43 | 0.43 | 0.43 | 0.43 |
| $BaSO_4$ | 20.5 | 20.5 | 20.5 | 20.5 |
| Yel MB | 0.10 | 0.10 | 0.10 | 0.10 |
| Zinc diacrylate | 26.9 | 26.9 | 26.9 | 26.9 |
| Zinc Oxide | 5.0 | 2.5 | — | — |
| Calcium Oxide | — | — | — | 5.0 |

TABLE II

| | Control | 1 | 2 | 3 |
|---|---|---|---|---|
| Zinc Oxide (pph) | 5.0 | 2.5 | — | — |
| Calcium Oxide (pph) | — | — | — | 5.0 |
| Core Initial Velocity | 250.79 | 250.83 | 250.19 | 250.33 |
| Ball Initial Velocity | 253.47 | 253.42 | 253.01 | 253.44 |
| Core PGA Compression | 80.4 | 77.1 | 68.4 | 71.3 |
| Ball PGA Compression | 97.8 | 96.2 | 85.8 | 90.3 |

EXAMPLES 4–8

The cores and finished balls of these examples were prepared according to the method used in Examples 1–3. However, the zinc oxide concentration was varied over a wider range. TABLE III provides a description of the contents of the balls used in each of these examples. Again the quantities are in terms of parts per 100 parts of polybutadiene.

TABLE III

| | Control | 4 | 5 | 6 | 7 | 8 |
|---|---|---|---|---|---|---|
| Polybutadiene | 100.0 | 100.0 | 100.0 | 100.0 | 100.0 | 100.0 |
| Regrind | 16.3 | 16.3 | 16.3 | 16.3 | 16.3 | 16.3 |
| Vulcup 40KE ® | 0.23 | 0.23 | 0.23 | 0.23 | 0.23 | 0.23 |
| Varox 231XL ® | 0.43 | 0.43 | 0.43 | 0.43 | 0.43 | 0.43 |
| $BaSO_4$ | 20.5 | 20.5 | 20.5 | 20.5 | 20.5 | 20.5 |
| Yel.MB | 0.10 | 0.10 | 0.10 | 0.10 | 0.10 | 0.10 |
| Zinc Diacrylate | 26.9 | 26.9 | 26.9 | 26.9 | 26.9 | 26.9 |
| Zinc Oxide | 5.0 | 3.75 | 2.5 | 1.25 | — | — |
| Calcium Oxide | — | — | — | — | — | 5.0 |

TABLE IV illustrates the PGA compression ratings and initial velocity results for Examples 4–8. These results were obtained by the same measurement techniques described above. The results further show that small decreases in the zinc oxide concentration have little or no effect on the compression and initial velocities of either the cores or the complete golf balls. However, the complete removal of zinc oxide results in significant reductions in compression, i.e., 10.6 points for the cores and 6.2 points for the complete golf balls, and a significant reduction in the initial velocities of both the cores and the completed golf balls. The present invention, as discussed above, comprises embodiments wherein the zinc oxide is totally excluded, as well as those in which the zinc oxide is present, but in significantly reduced amounts due to the addition of the calcium oxide. Example 8 shows that the replacement of the zinc oxide filler with calcium oxide provides a reduction in core compression of 9.1 points and a reduction in ball compression of 8.5 points, while the initial velocity of both the core and the complete ball in the USGA test are again comparable.

TABLE IV

| | Control | 4 | 5 | 6 | 7 | 8 |
|---|---|---|---|---|---|---|
| Zinc Oxide (pph) | 5.0 | 3.75 | 2.5 | 1.25 | — | — |
| Calcium Oxide (pph) | — | — | — | — | — | 5.0 |
| Core Initial Velocity | 250.36 | 251.00 | 250.79 | 250.80 | 249.95 | 250.14 |
| Ball Initial Velocity | 252.50 | 252.89 | 252.83 | 252.78 | 252.14 | 252.67 |
| Core PGA Compression | 76.5 | 76.4 | 73.8 | 73.8 | 65.9 | 67.4 |
| Ball PGA Compression | 93.8 | 96.0 | 94.2 | 93.7 | 87.6 | 87.5 |

EXAMPLES 9–10

The cores and finished balls of these examples were prepared according to the method used in Examples 1–8. However some variations were made to the amounts of ingredients used as shown in TABLE V. Again the quantities are in terms of parts per 100 parts of polybutadiene. TABLE VI illustrates the PGA compression ratings and initial velocity results for Examples 9–10. These results were obtained by the same measurement techniques described above. The results further show that the compositions of this invention generally provide cores and finished balls with decreased PGA compression rating, yet with an initial velocity comparable to higher compression balls.

TABLE V

| | Control | 9 | 10 |
|---|---|---|---|
| Polybutadiene | 100.0 | 100.0 | 100.0 |
| Regrind | 16.3 | 16.3 | 16.3 |
| Vulcup 40KE ® | 0.23 | 0.23 | 0.23 |
| Varox 231XL ® | 0.43 | 0.43 | 0.43 |
| $BaSO_4$ | 20.5 | 20.5 | 20.5 |
| Yel. MB | 0.10 | 0.10 | 0.10 |
| Zinc Diacrylate | 26.9 | 26.9 | 26.9 |
| Zinc Oxide | 5.0 | 1.25 | — |
| Calcium Oxide | — | — | 5.0 |

TABLE VI

| | Control | 9 | 10 |
|---|---|---|---|
| Zinc Oxide (pph) | 5.0 | 1.25 | — |
| Calcium Oxide (pph) | — | — | 5.0 |
| Core Initial Velocity | 250.94 | 250.98 | 250.66 |
| Ball Initial | 253.18 | 253.04 | 252.97 |

TABLE VI-continued

| | Control | 9 | 10 |
|---|---|---|---|
| Velocity | | | |
| Core PGA Compression | 79.4 | 75.2 | 73.1 |
| Ball PGA Compression | 97.7 | 96.6 | 92.5 |

EXAMPLES 11–19

These examples show the effects of varying the concentration of both zinc oxide and calcium oxide. The concentrations of the ingredients used in the various compositions are shown in TABLE VII. Again the quantities of the ingredients are in terms of parts per 100 parts of polybutadiene.

TABLE VIII illustrates the PGA compression ratings and initial velocity results for Examples 11–19. These results were obtained by the same measurement techniques described above. The results show that the advantages of the present invention are available with amounts of calcium oxide as low as 1.25 pph.

While it is apparent that the invention herein disclosed is well calculated to fulfill the objects above stated, it will be appreciated that numerous modifications and embodiments may be devised by those skilled in the art. It is intended that the appended claims cover all such modifications and embodiments as fall within the true spirit and scope of the present invention.

TABLE VII

| | Control | 11 | 12 | 13 | 14 | 15 | 16 | 17 | 18 | 19 |
|---|---|---|---|---|---|---|---|---|---|---|
| Polybutadiene | 100 | 100 | 100 | 100 | 100 | 100 | 100 | 100 | 100 | 100 |
| Regrind | 16.3 | 16.3 | 16.3 | 16.3 | 16.3 | 16.3 | 16.3 | 16.3 | 16.3 | 16.3 |
| Vulcup 40KE ® | 0.23 | 0.23 | 0.23 | 0.23 | 0.23 | 0.23 | 0.23 | 0.23 | 0.23 | 0.23 |
| Varox 231XL ® | 0.43 | 0.43 | 0.43 | 0.43 | 0.43 | 0.43 | 0.43 | 0.43 | 0.43 | 0.43 |
| $BaSO_4$ | 20.5 | 22.0 | 23.1 | 24.2 | 25.8 | 21.5 | 22.5 | 23.5 | 24.7 | 12.0 |
| Yel.MB | 0.10 | 0.10 | 0.10 | 0.10 | 0.10 | 0.10 | 0.10 | 0.10 | 0.10 | 0.10 |
| Zinc Diacrylate | 26.9 | 26.9 | 26.9 | 26.9 | 26.9 | 26.9 | 26.9 | 26.9 | 26.9 | 26.9 |
| Zinc Oxide | 5.0 | 3.75 | 2.50 | 1.25 | — | — | — | — | — | — |
| Calcium Oxide | — | — | — | — | — | 5.0 | 3.75 | 2.50 | 1.25 | 15.0 |

TABLE VIII

| | Control | 11 | 12 | 13 | 14 | 15 | 16 | 17 | 18 | 19 |
|---|---|---|---|---|---|---|---|---|---|---|
| Zinc Oxide (pph) | 5.0 | 3.75 | 2.50 | 1.25 | — | — | — | — | — | — |
| Calcium Oxide (pph) | — | — | — | — | — | 5.0 | 3.75 | 2.50 | 1.25 | 15.0 |
| Core Initial Velocity | 250.63 | 250.74 | 250.55 | 250.52 | 249.38 | 250.56 | 250.30 | 250.21 | 250.24 | 248.56 |
| Ball Initial Velocity | 252.62 | 252.83 | 252.62 | 252.43 | 251.71 | 252.91 | 252.80 | 252.81 | 252.55 | 250.92 |
| Core PGA Compression | 81.2 | 81.8 | 78.8 | 78.4 | 70.1 | 69.7 | 68.8 | 69.2 | 70.5 | 44.1 |
| Ball PGA Compression | 97.0 | 100.3 | 98.3 | 96.8 | 89.6 | 88.2 | 87.6 | 86.4 | 88.4 | 62.8 |

I claim:

1. A method of manufacturing a low PGA compression golf ball, which comprises:

forming a first mixture comprising polybutadiene, calcium oxide in an amount of about 0.1 to 15 parts per 100 parts of polybutadiene; and, from about 20 to 50 parts per 100 of a metal salt of a material selected from the group consisting of diacrylates, dimethacrylates, and monomethacrylates;

combining at least one free radical initiator with the first mixture to form a golf ball core composition; and forming a golf ball core from the composition.

2. The method of claim 1 further comprising combining the polybutadiene and the metal salt prior to adding the calcium oxide to form the first mixture.

3. The method of claim 1, further comprising forming the first mixture with the calcium oxide in an amount of about 1 to 10 parts per 100 parts of the polybutadiene.

4. The method of claim 1, further comprising forming the first mixture with the calcium oxide in an amount of about 1.25 to 5 parts per 100 parts of the polybutadiene.

5. The method of claim 1, further comprising forming the first mixture with a polybutadiene having a cis-1,4-polybutadiene content of at least about 90%.

6. The method of claim 1, further comprising molding the golf ball core composition into a unitary golf ball.

7. The method of claim 1 which further comprises selecting at least one peroxide for use as the free radical initiator.

8. A method of manufacturing a low PGA compression golf ball core comprising the steps of:

forming a first mixture substantially free of zinc oxide, said first mixture comprising polybutadiene, zinc diacrylate in an amount of about 20 to about 50 parts per 100 parts of polybutadiene, and calcium oxide in an amount of about 0.1 to about 15 parts per 100 parts of polybutadiene;

allowing the temperature of the first mixture to rise to a range at which a free radical initiator added thereto will form free radicals;

combining a free radical initiator with the first mixture to form a golf ball core composition; and forming a golf ball core from the composition.

9. The method of claim 8 which further comprises selecting at least one peroxide for use as the free radical initiator.

10. The method of claim 9, wherein the free radical initiator is added at a temperature ranging between about 80° and 200° F.

11. A golf ball core, produced according to the method of claim 8.

12. A golf ball comprising a core formed according to claim 8.

13. A low PGA compression golf ball comprising a cover and a core, wherein the core is formed from a mixture, substantially free of zinc oxide, said mixture comprising polybutadiene, a metal salt of a material selected from the group consisting of diacrylates, dimethacrylates, and monomethacrylates, and calcium oxide, wherein the amount of the calcium oxide is sufficient to reduce the compression of a golf ball by at least about 2 PGA compression points compared to a core consisting of the same mixture wherein zinc oxide is substituted in place of the calcium oxide.

14. The golf ball of claim 13, wherein the amount of calcium oxide in said mixture is from about 0.1 to 15 parts per 100 parts of polybutadiene.

15. The golf ball of claim 13, wherein the amount of calcium oxide in said mixture is from about 1 to about 10 parts per 100 parts of polybutadiene.

16. The golf ball of claim 13, wherein the amount of calcium oxide in said mixture is from about 1.25 to 5 parts per 100 parts of polybutadiene.

17. The golf ball of claim 13, wherein the polybutadiene has a cis-1,4-polybutadiene content of at least about 90%.

18. The golf ball of claim 13, wherein the polybutadiene has a cis-1,4-polybutadiene content of at least about 96%.

19. The golf ball of claim 13, wherein the amount of the metal salt in said mixture is about 20 to 50 parts per 100 parts of polybutadiene.

20. The golf ball of claim 19, wherein the metal salt is zinc diacrylate.

21. The golf ball of claim 13, wherein the core further comprises a filler selected from the group consisting of barium sulfate, regrind, limestone, and mixtures thereof.

22. A low PGA compression golf ball core composition substantially free of zinc oxide, said composition comprising polybutadiene, a metal salt of a material selected from the group consisting of diacrylates, dimethacrylates, and monomethacrylates and calcium oxide in an amount of about 0.1 to 15 parts per 100 parts of said polybutadiene.

23. The golf ball core composition of claim 22, wherein the amount of calcium oxide, in said composition is from about 1 to about 10 parts per 100 parts of said polybutadiene.

24. The golf ball core composition of claim 22, wherein the amount of calcium oxide in said composition is from about 1.25 to about 5 parts per 100 parts of said polybutadiene.

25. The golf ball core composition of claim 22, wherein the polybutadiene has a cis-1,4-polybutadiene content of at least about 90%.

26. The golf ball core composition of claim 22, wherein the metal salt is zinc diacrylate.

* * * * *

UNITED STATES PATENT AND TRADEMARK OFFICE
CERTIFICATE OF CORRECTION

PATENT NO. : 5,721,304

DATED : February 24, 1998

INVENTOR(S) : Samuel A. Pasqua, Jr.

It is certified that error appears in the above-identified patent and that said Letters Patent is hereby corrected as shown below:

In column 4, at line 53, please change "his(t-butylperoxy)" to read --bis(t-butylperoxy)--.

In column 6, line 29, please delete the word "is".

Signed and Sealed this

Twenty-eighth Day of April, 1998

Bruce Lehman

*Attest:*

BRUCE LEHMAN

*Attesting Officer*

*Commissioner of Patents and Trademarks*